US005336281A

United States Patent [19]

Winston et al.

[11] Patent Number: 5,336,281

[45] Date of Patent: Aug. 9, 1994

[54] BLAST MEDIA CONTAINING SURFACTANT-CLATHRATE COMPOUND

[75] Inventors: Anthony E. Winston, East Brunswick; Benny S. Yam, Holmdel, both of N.J.; Keith A. Jones, Yardley, Pa.

[73] Assignee: Church & Dwight Co., Inc., Princeton, N.J.

[21] Appl. No.: 193,762

[22] Filed: Feb. 3, 1994

Related U.S. Application Data

[62] Division of Ser. No. 6,659, Jan. 21, 1993.

[51] Int. Cl.[5] ..... C09C 1/68

[52] U.S. Cl. ..... 51/307; 252/38; 252/128; 252/131; 252/174.14

[58] Field of Search ..... 51/307, 309; 106/3; 252/38, 128, 131, 160, 174.14

[56] References Cited

U.S. PATENT DOCUMENTS

| | | | |
|---|---|---|---|
| 2,605,596 | 8/1952 | Uhri | 51/282 |
| 2,817,195 | 12/1957 | Curtin | 51/282 |
| 3,142,590 | 7/1964 | Hergonson | 134/7 |
| 3,607,161 | 9/1971 | Monick | 106/3 |
| 3,764,541 | 10/1973 | Kaneko | 252/89 |
| 4,125,969 | 11/1978 | Easton | 51/320 |
| 4,347,152 | 8/1982 | Wixon | 252/174 |
| 4,545,155 | 10/1985 | Nakata | 51/320 |
| 4,751,016 | 6/1988 | Tse et al. | 51/309 |
| 4,802,312 | 2/1989 | Glaeser et al. | 51/321 |
| 4,992,198 | 2/1991 | Nebashi et al. | 252/174 |
| 5,112,406 | 5/1992 | Lajoie et al. | 134/7 |
| 5,146,716 | 9/1992 | Lynn | 51/320 |
| 5,160,547 | 11/1992 | Kirschner et al. | 134/7 |
| 5,205,954 | 4/1993 | Amed et al. | 252/174.14 |
| 5,244,468 | 9/1993 | Harris et al. | 252/174.14 |

OTHER PUBLICATIONS

Advertisement-"Please Your Toughest Customer", Armex® Blast Media, Accustrip System TM, ©1992, Church & Dwight Co., Ltd.

*Primary Examiner*—Mark L. Bell
*Assistant Examiner*—Deborah Jones
*Attorney, Agent, or Firm*—Charles B. Barris

[57] ABSTRACT

A blast media for stripping contaminants from a solid surface comprises abrasive particles and a surfactant in the form of a granular surfactant-clathrate compound formed of a surfactant and a water soluble compound having clathration capability such as urea. The surfactant reduces the amount of water soluble residues which remain on the targeted surface and enhances the removal of dirt, grease and oil from the targeted surface.

15 Claims, No Drawings

BLAST MEDIA CONTAINING SURFACTANT-CLATHRATE COMPOUND

This application is a division of application Ser. No. 08006,659, filed Jan. 21, 1993.

FIELD OF THE INVENTION

The present invention relates to improvements in blast media utilized to remove adherent material such as paint, scale, dirt, grease and the like from solid surfaces. In particular, the present invention is directed to an abrasive blast media which has incorporated therein a surfactant to enhance contaminant removal from the targeted surface.

DESCRIPTION OF THE PRIOR ART

In order to clean a solid surface so that such surface can again be coated such as, for example, to preserve metal against deterioration, remove graffiti from stone or simply to degrease or remove dirt from a solid surface, it has become common practice to use an abrasive blasting technique wherein abrasive particles are propelled by a high pressure fluid against the solid surface in order to dislodge previously applied coatings, scale, dirt, grease or other contaminants. Various abrasive blasting techniques have been utilized to remove coatings, grease and the like from solid surfaces. Thus, blasting techniques comprising dry blasting which involves directing the abrasive particles to a surface by means of pressurized air typically ranging from 30 to 150 psi, wet blasting in which the abrasive blast media is directed to the surface by a highly pressurized stream of water typically 3,000 psi and above, multi-step processes comprising dry or wet blasting and a mechanical technique such as sanding, chipping, etc. and a single step process in which both air and water are utilized either in combination at high pressures to propel the abrasive blast media to the surface as disclosed in U.S. Pat. No. 4,817,342, or in combination with relatively low pressure water used as a dust control agent or to control substrate damage have been used. Water for dust control has been mixed with the air either internally in the blast nozzle or at the targeted surface to be cleaned and such latter process, although primarily a dry blasting technique, is considered wet blasting inasmuch as media recovery and clean up is substantially different from that utilized in a purely dry blasting operation.

The blast media or abrasive particles most widely used for blasting surfaces to remove adherent material therefrom is sand. Sand is a hard abrasive which is very useful in removing adherent materials such as paint, scale and other materials from metal surfaces such as steel. While sand is a most useful abrasive for each type of blasting technique, there are disadvantages in using sand as a blast media. For one, sand, i.e., silica, is friable and upon hitting a metal surface will break into minute particles which are small enough to enter the lungs. These minute silica particles pose a substantial health hazard. Additionally, much effort is needed to remove the sand from the surrounding area after completion of blasting. Still another disadvantage is the hardness of sand itself. Thus, sand cannot readily be used as an abrasive to remove coatings from relatively soft metals such as aluminum or any other soft substrate such as plastic, plastic composite structures, concrete or wood, as such relatively soft substrates can be excessively damaged by the abrasiveness of sand. Moreover, sand cannot be used around moving parts of machinery inasmuch as the sand particles can enter bearing surfaces and the like.

An alternative to sand as a blast media, particularly, for removing adherent coatings from relatively soft substrates such as softer metals as aluminum, composite surfaces, plastics, concrete and the like is sodium bicarbonate. While sodium bicarbonate is softer than sand, it is sufficiently hard to remove coatings from aluminum surfaces and as well remove other coatings including paint, dirt, and grease from non-metallic surfaces without harming the substrate surface. Sodium bicarbonate is not harmful to the environment and is most advantageously water soluble such that the particles which remain subsequent to blasting can be simply washed away without yielding environmental harm. Since sodium bicarbonate is water soluble and is benign to the environment, this particular blast media has also found increasing use in removing coatings, cleaning dirt, grease and oil and the like from hard surfaces such as steel and interior surfaces such as those which contact food such as in environments of food processing or handling.

Sodium bicarbonate is also a friable abrasive and, like sand, will form a considerable amount of dust during the blast cleaning process. To control the dust formed by the sodium bicarbonate blast media as it contacts the targeted surface, water is included in the pressurized fluid carrier medium. Thus, water can be used as the carrier fluid or, more preferably, injected into a pressurized air stream which carries the blast media from the blast nozzle to the targeted surface. Water as a means to control dust has been mixed with the air stream internally in the blast nozzle or into the air stream externally of the nozzle. The addition of water to the pressurized air stream has been very effective in controlling dust formed by the sodium bicarbonate blast media. One disadvantageous result, however, of utilizing water to control the dust formed by the sodium bicarbonate blast media is that a residue of the water soluble sodium bicarbonate, flow aid or even calcium carbonate formed by reaction of water hardness ions with the bicarbonate remains on the substrate surface. Even after rinsing the substrate with water, this residue can remain leaving an unsightly film on the cleaned surface.

In copending, commonly assigned U.S. application Ser. No. 08/006,658, filed Jan. 21, 1993, it is suggested to add a surfactant with the blast media. The surfactant minimizes the amount of residue which remains on the targeted surface subsequent to blasting and causes any residue which remains to be readily removed by washing with water. A wide variety of surfactants are available which can achieve the improved rinsing feature of the invention disclosed therein. Additionally, the additive surfactant or mixture of surfactants can enhance the detersive properties of the blast media and, thus, enhance removal of dirt, grease, oil and the like from the substrate surface. Various methods are disclosed therein for adding the surfactant to the blast media. Thus, anionic surfactants which are typically solids can be mixed as is with the abrasive particles and such surfactants have been found most useful in reducing residue formation on the substrate surface. Nonionic surfactants very useful in cleaning dirt, grease, oil and the like from the substrates are typically in liquid form and can be directly sprayed on the abrasive blast media particles, incorporated with carrier particles which are then mixed with the abrasive blast media particles or the surfactant can be added to the water stream which is utilized to carry the blast media to the substrate surface or used as a dust control agent.

Unfortunately, each of the techniques for adding the surfactant, in particular, the liquid nonionic surfactants, to the blast media has disadvantages. Thus, in the case of adding the liquid surfactant directly onto the abrasive blast media particles such as by spray coating and the like, there is a tendency for the blast media to agglomerate causing the particles to cake and bridge together. The agglomeration, caking, bridging and the like of the abrasive particles drastically reduces the free flow thereof through metering devices which dispense the media to the blast nozzle. If carrier particles are utilized, the surfactants are not readily leached therefrom and, accordingly, either a large amount of surfactant must be utilized or there is not as much as an advantage of using the surfactant as could be realized. Non-water soluble carrier particles also add to the disposal costs. Further, the nonionic surfactants tend to gel when placed in contact with water, slowing the dissolution thereof in the water stream. Moreover, adding the surfactant directly to the water stream involves additional dispensing equipment and as well uniform mixing of the abrasive blast particles with the separate surfactant stream may not be realized.

Accordingly, it is the primary objective of the present invention to make improvements in water soluble blast media so as to reduce the residue of the media which remains on the targeted surface subsequent to blasting and to render any residue which remains readily removable, and/or enhance the detersive action of the blast media to remove adhered contaminants from solid surfaces.

Another object of the present invention is to provide an improved process for blast cleaning a targeted surface with a water soluble abrasive blast media which does not leave an anchored residue on the targeted surface.

Still another object of the present invention is to incorporate a surfactant with an abrasive blast media in a manner which will ensure uniform dispersal of the surfactant throughout the blast media and at the same time will not adversely affect the free flow of the blast media particles through the blast nozzle to the targeted substrate.

Yet, another object of the invention is to incorporate a surfactant with an abrasive blast media in a manner to enhance the dissolution of the surfactant in water.

SUMMARY OF THE INVENTION

The above objects of the present invention are achieved by incorporating with a free-flowing powdery, water soluble blast media a small amount of a surfactant in the form of a granulated surfactant-clathrate compound. The invention provides a powdery, abrasive blast media which comprises a water-soluble abrasive and clathrate granules of a surfactant-clathrate compound comprising a surfactant and a water soluble compound having a clathrate capability. The blast media remains powdery, free-flowing and provides an intimate and uniform mixture of the surfactant with the abrasive particles. The surfactant is released from the clathrate and dissolves almost instantly when contacted with water.

The addition of the surfactant reduces the residues of the water soluble media which remain on the targeted surface and any residue which does remain can be easily removed by rinsing with fresh water. The surfactant appears to lower the surface tension of the water droplets containing dissolved media and attached to the substrate surface causing the droplets to be readily washed from the surface before the solubilized media can dry. The surfactant can also enhance the removal of contaminants, such as paint, resin, dirt, grease and oil from the substrate surface.

The present invention also provides a process for preparing the blast media composition in which a liquid surfactant is added to the abrasive blast particles to yield a free-flowing, powdery blast media having improved rinsing properties and/or detersive properties. Various methods are provided for incorporating the liquid surfactant into a granular surfactant-clathrate compound and for mixing such compound with the abrasive particles which form the blast media.

The invention is also characterized by a process for blast cleaning a solid surface using a powdery, free-flowing, blast media which comprises a mixture of abrasive particles and granular surfactant-clathrate compound to remove contaminants from the targeted substrate surface.

DETAILED DESCRIPTION OF THE INVENTION

The blast media to be utilized are water soluble abrasive particles, typically having average sizes of about 10 to 1,000 microns in diameter. Preferably, the blast media will comprise abrasive particles having an average size of from about 50–500 microns and wherein the amount of particles above 1,000 microns does not exceed about 1% of the total media. Water soluble blast media are advantageous since such blast media can be readily disposed of by a water stream, are readily separated from the insoluble paints and resins which have been stripped to facilitate waste disposal, and since most water soluble blast media are relatively soft, i.e., Mohs hardness less than 3.0, such media can be utilized to remove coatings, grease, dirt and the like from a variety of substrates including relatively soft metals such as aluminum as well as plastic, ceramic, concrete, wood and composites of such materials. Water-soluble abrasive particles having a Mobs hardness of less than 5.0 are generally useful in blast cleaning softer substrates. Non-limiting examples of water soluble blast media which can be utilized include the alkali metal and alkaline earth metal salts such the chlorides, chlorates, carbonates, bicarbonates, sulfates, silicates, the hydrates of the above, etc. The preferred blast media are the alkali metal salts and, in particular, the sodium and potassium carbonates, bicarbonates and sulfates. The most preferred blast media are the alkali metal bicarbonates as exemplified by sodium bicarbonate. Also preferably useful are sodium sesquicarbonate, natural sodium sesquicarbonate known as trona, sodium bicarbonate, sodium carbonate, potassium carbonate, potassium bicarbonate, sodium chloride and sodium sulfate which is described in commonly assigned U.S. Pat. No. 5,112,406. It is important to note that by water soluble is not meant completely water soluble as some salts and natural minerals such as trona may contain minor amounts of insoluble materials. For example, trona which is a natural sodium sesquicarbonate may contain up to 10 wt. % of insolubles. Thus, by water soluble is meant to include those materials which are substantially soluble in water and sufficiently soluble to leave a water soluble residue on a targeted surface.

To reduce the formation of residues of blast media which remain on the substrate surface, and/or to enhance the cleaning activity of the blast media, the blast media of the present invention includes a surfactant. The surfactant which may be utilized can be anionic, nonionic, amphoteric or mixtures thereof. The surfactant is provided in granular form by adding the surfactant as a dried surfactant-clathrate compound. The disadvantages of adding a liquid to the powdery blast media are avoided and, as well, the clathrate enhances the dissolution of the surfactant in the water stream. The clathrates are most effectively prepared from compounds containing long chain carbon groups although it is not exactly clear what molecular features are necessary for clathration. Non-limiting examples of surfactants which can most readily form clathrates include anionic surfactants such as polycarboxylated ethylene oxide condensates of fatty alcohols manufactured by Olin under the tradename of "Polytergent CS-1" and nonionic surfactants such as polyoxyethylene-polyoxypropylene condensates, which are sold under the tradename "Pluronic", polyoxyethylene condensates of alkyl phenols; polyoxyethylene condensates of aliphatic alcohols/ethylene oxide condensates having from 1 to 30 moles of ethylene oxide per mole of coconut alcohol; ethoxylated long chain alcohols sold under the tradename "Nedol", polyoxyethylene condensates of sorbitan fatty acids, alkanolamides, such as the monoalkoanolamides, dialkanolamides and the ethoxylated alkanolamides, for example coconut monoethanolamide, lauric isopropanolamide and lauric diethanolamide; and amine oxides for example dodecyldimethylamine oxide.

It may be desirable in some instances to utilize a combination of a dry clathrate compound containing surfactant together with an additional dry surfactant which does not need to be clathrated. For example, most anionic surfactants are dry and particularly useful in reducing residue formation. The anionic surfactant to be effective needs to be soluble in water saturated with the dissolved media. The use of an anionic surfactant and a clathrated nonionic surfactant yields residue reduction and enhanced cleaning action of the blast media. Further, it has been found that the anionic surfactant aids in maintaining the nonionic surfactant in solution. Examples of suitable anionic surfactants include water-soluble salts of the higher alkyl sulfates, such as sodium lauryl sulfate or other suitable alkyl sulfates having 8 to 18 carbon atoms in the alkyl group, water-soluble salts of higher fatty acid monoglyceride monosulfates, such as the sodium salt of the monosulfated monoglyceride of hydrogenated coconut oil fatty acids, alkyl aryl sulfonates such as sodium dodecyl benzene sulfonate, higher alkyl sulfoacetates, higher fatty acid esters of 1,2-dihydroxy propane sulfonate, and the substantially saturated higher aliphatic acyl amides of lower aliphatic amino carboxylic acid compounds, such as those having 12 to 16 carbons in the fatty acid, alkyl or acyl radicals, and the like. Examples of the last mentioned amides are N-lauroyl sarcosinate, and the sodium, potassium, and ethanolamine salts of N-lauroyl, N-myristoyl, or N-palmitoyl sarcosinate.

Amphoteric surfactants are a well known class of surfactants which can be used as adjuncts including the alkyl beta-iminodipropionates $RN(C_2H_4COOM)_2$ and the alkyl beta-aminopropionates $RNHCH_4COOM$ where the alkyl group R contains 8 to 18 carbon atoms in both formulae and M is a salt-forming cation such as the sodium ion. Further examples are the long chain imidazole derivatives, for example, the di-sodium salt of lauroylcycloimidinium-1-ethoxy-ethionic acid-2-ethionic acid, and the substituted betaines such as alkyl dimethyl ammonio acetates where the alkyl group contains 12 to 18 carbon atoms. N-alkyl-2pyrrolidones which are highly polar apiotic solvents, are also surface active and can be used. "Surfadone LP-100" from International Specialty Products has been found particularly useful.

The compound having clathration capability must be water soluble so as to release the surfactant upon contact with water. The preferred clathrate is urea. Other clathrates which can be utilized include beta-cyclodextrin and derivatives thereof such as methylated beta-cyclodextrin, alpha-cyclodextrin, gama-cyclodextrin, etc.

The granulated surfactant-clathrate compound can be formulated in a variety of ways and subsequently incorporated into the abrasive blast media by several techniques. In one method, the granulated surfactant-clathrate compound is prepared by melting a clathrate and liquid surfactant mixture containing a ratio of about 2:1 to about 10:1 clathrate to surfactant, cooling the mixture to form a dry crystalline solid and then grinding the solid into particles which are then directly added to the abrasive blast medium as a dry powder. This melt technique is particularly useful when urea is used as the clathrate which has a melting point of about 133° C. To ensure intimate and uniform mixture of the granulated surfactant-clathrate compound with the abrasive blast medium, the clathrate can be prepared in the presence of the abrasive blast media particles to produce a dry particle of similar density to that of the medium.

Alternatively, a mixture of hot molten liquid surfactant and urea can be sprayed directly onto the abrasive blast media particles. In this method, when the clathrate solidifies, it will be tacked onto the abrasive media particles. Still another method comprises dissolving the clathrate and surfactant in an appropriate solvent without heating and spraying the solvated mixture onto the abrasive blast media particles. The solvent is subsequently allowed to evaporate and the clathrate forms directly on the abrasive blast media particles.

Still another method of forming the surfactant-clathrate compound and incorporating same into the abrasive blast media, comprises dissolving the clathrate and surfactant in water and spraying the solvated mixture onto the blast media particles and then drying. Drying can be accomplished in warm or hot air or, more preferably, warm or hot carbon dioxide if a bicarbonate is used as the abrasive blast media so as to prevent decomposition of the bicarbonate. Similarly, if bicarbonate particles are utilized, the coated particles can be dried by the addition of an anhydrous hydratable salt to the wet mixture.

The surfactant-clathrate compound in granular form will comprise from about 0.003 to about 5 wt. % of the blast media. The amount of the surfactant, per se, relative to the abrasive blast media should be from finite amounts to about 3 wt. % and preferably from about 0.05 to 0.5 wt. %.

Ideally, the granules of surfactant-clathrate compound should be similar in size to the abrasive particles to avoid segregation. Granule sizes of from about 10 to about 1,000 microns in diameter are useful.

It is also useful in accordance with the present invention to include a flow aid or a decaking agent with the blast media. Most preferably, the flow aid is a hydrophilic silica, hydrophobic silica, hydrophobic polysiloxane or mixture thereof.

Hydrophobic silica, unlike known hydrophilic silicas, is substantially free of non-hydrogen bonded silanol group and absorbed water. One preferred hydrophobic silica which may be utilized in the blasting media hereof is Aerosil R 972, a product which is available from DeGussa AG. This material is a pure coagulated silicon dioxide aerosol, in which about 75% of the silanol groups on the surface thereof are chemically reacted with dimethyldichlorosilane, the resulting product having about 0.7 mmol of chemically combined methyl groups per 100 $m^2$ of surface area and containing about 1% carbon. Its particles vary in diameter from about 10 to 40 nanometers and have a specific surface area of about 110 $m^2$/gram. It may be prepared by flame hydrolysis of a hydrophilic silica as more fully described in Angew. Chem., 72, 744 (1960); F-pS 1,368,765; and DT-AS 1,163,784. Further details respecting such material are contained in the technical bulletin entitled "Basic Characteristics and Applications of AEROSIL", DeGussa AG, August 986. The hydrophobic silica particles are admixed with the abrasive blasting media in the proportion of at least about 0.1 and up to about 1.0% by weight thereof. Another hydrophobic silica is Quso, marketed by DeGussa A.G.

Hydrophobic polysiloxanes, preferably non-halogenated polysiloxanes, suitable for use in the blasting media hereof are commercially marketed by Dow Corning and General Electric.

The blast media of the present invention as constituted from the water soluble abrasive particles and surfactant as described above are useful for efficient cleaning or decoating of sensitive metals such as aluminum or aluminum alloys, magnesium, or composite substrates, such as utilized on exterior aircraft surfaces, masonry, stucco, plaster, wood or plastics. Such blast media are preferably applied in commercial pressurized water and, more preferably, compressed air streams which contain water either added at the blast nozzle or externally therefrom so as to control dust formation. Blasting equipment for the blast media of the present invention are commercially available. The blast media flow rates through the blast nozzle typically range from about 0.5 to 15, desirably from about 1.0 to 10.0 lbs per minute and under air pressures from 10 to 100 psi and water pressures for dust control typically ranging from about 10 psi and above.

As indicated above and as more fully documented below, in accordance with the present invention, it has been found that the blast media of the present invention do not leave a substantial amount of residue on the targeted surface and that any residue which remains can be easily removed by the application of fresh water. Moreover, the blast media of the invention can be provided with a better cleaning capability by the incorporation of a surfactant which enhances the deterslye action of the blast media such as to remove dirt, oil and grease from the targeted substrate. Importantly, the blast media remains powdery and free flowing so that it can be readily projected against a substrate surface by means of commercially available blasting equipment.

While the use of a water soluble abrasive particle for the blast media is preferred, there are instances in which a surfactant, in particular, for enhancing the removal of dirt, grease and oil from substrates can be used with water insoluble blast media. Thus, the present invention is also directed to the addition of a surfactant-clathrate compound in granular form to any type of blast media including the water soluble blast media described previously as well as known water insoluble blast media as sand, plastics, rice hulls, walnut shells, calcium carbonate, magnesium carbonate, other alkaline earth metal salts and the like. The addition of a surfactant in the form a clathrate compound maintains the blast media in a free-flowing state which is required if air is the primary blast media carrier medium.

The following examples are for the purpose of illustrating the invention only and are not intended to limit the invention to the embodiments shown.

EXAMPLE I 1 part of an ethoxylated alcohol containing an average of 12 moles of ethylene oxide and a $C_{12}$–$C_{15}$ alcoholic chain is melted. This is added to 4 parts of molten urea at 150° C. The liquid mixture is allowed to cool and crystallize into a dry solid. The solid is ground into a dry powder having an average particle size of 75 $\mu$.

1% of this powder is mixed with blast media consisting of sodium bicarbonate particles with an average particle size of 75 $\mu$ and 0.5% of a hydrophobic silica flow aid. The blast media is a free flowing powder.

EXAMPLE II 1 part of an ethoxylated alcohol with an average of 7 moles of ethylene oxide and made from a $C_{14}$–$C_{15}$ alcoholic chain is clathrated with 5 parts of urea. The crystalline product is ground to an average particle size of 150 $\mu$.

0.6% of clathrate and 0.1% of dry powdered sodium lauroyl sarcosinate is added to sodium bicarbonate blast media of particle size 150 $\mu$. The blast media is a free flowing powder.

EXAMPLE III 6 parts of sulfated ethoxylated alcohol formed with 3 moles of ethylene oxide and an alcohol having a chain length of $C_{12}$–$C_{15}$ is dissolved in 3 parts water and 1 part ethanol. The surfactant solution is added to 24 parts of urea dissolved in 26 parts of methanol.

1.5% of the resulting solution is sprayed onto sodium bicarbonate blast media of average particle size 100 $\mu$. The alcohol and water are allowed to evaporate to provide a dry medium. 0.5% hydrophilic silica flow aid is added to improve flow. The media is free flowing with only a very slight amount of media clumping which is easily broken up.

What is claimed is:

1. A blast media useful in removing contaminants from a solid surface comprises a mixture of abrasive particles and a surfactant-clathrate compound comprising a surfactant and a compound having clathration capability.

2. The blast media of claim 1 wherein said abrasive particles are water soluble.

3. The blast media of claim 1 wherein said abrasive particles comprise sodium bicarbonate.

4. The blast media of claim 1 wherein said compound having clathration capability is water soluble.

5. The blast media of claim 4 wherein said compound having clathration capability is urea.

6. The blast media of claim 1 wherein said surfactant-clathrate compound is a granular free-flowing powder.

7. The blast media of claim 1 wherein said surfactant-clathrate compound is a granulated particle attached to said abrasive particles.

8. The blast media of claim 1 wherein said abrasive particles are water insoluble.

9. The blast media of claim 1 further including a flow aid.

10. The blast media of claim 1 wherein said surfactant comprises from a finite amount to 3 wt. % of said blast media.

11. The blast media of claim 1 wherein said surfactant is nonionic.

12. The blast media of claim 11 wherein said blast media further includes a non-clathrated surfactant.

13. The blast media of claim 12 wherein said non-clathrated surfactant is anionic.

14. The blast media of claim 11 wherein said surfactant-clathrate compound comprises from about 0.003 to about 5 wt. % of said blast media.

15. The blast media of claim 8 wherein said abrasive particles comprise calcium carbonate.

* * * * *